US005864102A

United States Patent [19]

Jamieson et al.

[11] Patent Number: 5,864,102

[45] Date of Patent: Jan. 26, 1999

[54] DUAL MAGNET CONTROLLER FOR AN ELEVATOR ACTIVE ROLLER GUIDE

[75] Inventors: Eric K. Jamieson, Farmington; Thomas He, Unionville; Daniel S. Williams, Meriden, all of Conn.

[73] Assignee: Otis Elevator Company, Farmington, Conn.

[21] Appl. No.: 858,001

[22] Filed: May 16, 1997

[51] Int. Cl.[6] ..... B66B 11/02

[52] U.S. Cl. ..... 187/292; 187/409; 187/393

[58] Field of Search ..... 187/393, 409, 187/292

[56] References Cited

U.S. PATENT DOCUMENTS

| | | | |
|---|---|---|---|
| 4,899,852 | 2/1990 | Salmon et al. | 187/1 R |
| 5,294,757 | 3/1994 | Skalski et al. | 187/115 |
| 5,321,217 | 6/1994 | Traktovenko et al. | 187/115 |
| 5,329,077 | 7/1994 | Skalski et al. | 187/133 |
| 5,367,132 | 11/1994 | Skalski et al. | 187/393 |
| 5,368,132 | 11/1994 | Hollowell et al. | 187/393 |
| 5,373,123 | 12/1994 | Skalski | 187/393 |
| 5,379,864 | 1/1995 | Colby | 187/393 |
| 5,490,577 | 2/1996 | Yoo | 187/252 |
| 5,524,730 | 6/1996 | Roberts | 187/292 |
| 5,535,853 | 7/1996 | Skalski | 187/410 |
| 5,597,988 | 1/1997 | Skalski | 187/393 |
| 5,617,023 | 4/1997 | Skalski | 324/207.17 |
| 5,652,414 | 7/1997 | Roberts et al. | 187/292 |

FOREIGN PATENT DOCUMENTS 0467673 1/1992 European Pat. Off. ..... B66B 11/02

*Primary Examiner*—Robert Nappi

[57] ABSTRACT

A dual magnet controller, as part of an active roller guide (ARG) controller, that requires that each controlled actuator produce at least a minimum idling force, rather than carrying a minimum idling current. The dual magnet controller for a particular control axis determines force commands for its pair of actuators based on the actuators in combination having to produce a net force, and each actuator independently having to produce a force equal in magnitude at least to a pre-determined minimum idling force. The net force may be calculated by other elements of the ARG controller and communicated as input to the dual magnet controller.

3 Claims, 4 Drawing Sheets

DUAL MAGNET CONTROLLER FOR AN ELEVATOR ACTIVE ROLLER GUIDE

BACKGROUND OF THE INVENTION

1. Technical Field

The present invention pertains to the field of elevator control. More particularly, the present invention pertains to an active roller guide controller used to control the motion of an elevator transverse to the rail guides it rides on.

2. Description of Related Art

One type of active roller guide (ARG) system uses actuable springs (unparallel) and an electromagnetic actuator having an airgap between the poles of its electromagnet and a reaction bar slidably attached to a rail guide. The actuator is attached to the elevator. Current in the windings of the electromagnet produces magnetic flux that extends into the airgap. The square of the magnetic flux density in the airgap is directly related to the force of attraction between the electromagnet and the reaction bar, and hence between the elevator and the rail guide.

These active roller guides now sometimes use a pair of electromagnets to generate forces in opposite directions along a control axis at the location of the roller guides. The prior art active roller guides of this sort use flux feedback from each electromagnet. A force control loop, sometimes implemented using an analog computer, steers to the appropriate magnet a force dictation (a command to produce a specified force), depending on which direction the elevator is to be forced. In this prior art, each electromagnet always carries a minimum current, called here an idling current, even when not called upon to deliver force.

Because the windings of an actuator's electromagnet are finite in conductivity, all actuators are current-limited, and hence are also force limited. There is a maximum current the windings can carry, and hence a maximum force an actuator can produce. The force provided by an electromagnet is a nonlinear function of both the winding current and the airgap; it increases with the square of the current, and is inversely proportional to the square of the airgap.

When an elevator is forced away from a desired position on a control axis, the airgap for one actuator increases while that for the other decreases. When an airgap is at the large end of an operating range, typically at about 12 mm, the maximum force that can be generated is typically about 250N before a typically 10 A current limit is reached. At the opposite extreme, when the airgap is at the small end of the operating range, typically about 2.0 mm, assuming that the actuator magnet is idling at a typically minimum idling current of 1.0 A, the force produced by that idling current will be larger than 250N. When the system enters this configuration, the controller cannot free it. This locking up is called magnet stiction.

Essentially, stiction tends to develop in the prior art because a minimum idling current based control system is unstable with respect to holding an elevator at any location on a control axis away from both rail guides, so that neither airgap is too small. A minimum idling current amounts to a variable idling force, because the force depends on the airgap, which can vary; if the airgap decreases, then for the same current, the force produced by the magnet increases. This increasing force represents magnet stiction; it must be overcome by a larger current in an opposing magnet. But the opposing magnet has a larger airgap corresponding to the smaller airgap of the first magnet; and to produce an opposing force equal in magnitude to the force of the first magnet, a very much larger current is necessary. Thus, the minimum idling current based system is unstable because control is current-limited.

Magnet stiction cannot be overcome simply by reducing the idling current for two reasons. First, the lower the idling current, the greater the delay before a magnet can respond to a command to produce a certain level of force. Second, another component of an active roller guide, namely a centering controller, uses current feedback to calculate the lateral position of the elevator, and if too small an idling current were used, then at large airgaps, the flux feedback would be too small for reliable position calculation.

What is needed is a control system that avoids this unstable behavior caused by using a minimum idling current for each magnet.

SUMMARY OF THE INVENTION

The present invention modifies an active roller guide according to the prior art by using a dual magnet controller that commands each electromagnet to produce at least a minimum idling force, not a minimum idling current, even when the pair of actuators is not called upon to deliver a net force. In this arrangement, if the airgap at one actuator decreases, then the current will be decreased to keep the force set to the minimum idling force; the airgap at the other actuator will have increased and more current will be required to produce a force equal in magnitude and opposite in direction to the force produced by the first actuator. However, the current required to produce this equal and opposite minimum idling force in a second actuator will be less than what would have been required had the current in the first actuator not been decreased.

The present invention uses a dual magnet controller that includes a control loop for each magnet. Depending on the polarity of the net force required of the actuators acting in combination, each magnet control loop commands an actuator force that is either the idling force or essentially the net force added to the idling force. Thus the two magnets in combination always produce essentially the net force, while each produces a force equal in magnitude at least to the idling force.

It is an object of the present invention to modify an active roller guide according to the prior art to eliminate some unstable behavior arising from operation based on a minimum idling current, thereby decreasing the amplitude of vibration of the elevator car, and thus producing a smoother ride for passengers.

It is a further object of the present invention to allow for a wider range in airgap between a reaction bar and an electromagnet of an actuator by making possible the use of lower current in the electromagnet.

In the present invention the above objects are achieved by a dual magnet controller in an active roller guide for an elevator slidably and flexibly coupled to a pair of rail guides extending along a vertical hoistway, the active roller guide for controlling lateral motion of the elevator, the active roller guide including:

a pair of actuators, each actuator having an electromagnet attached to the elevator adjacent a reaction bar, each reaction bar slidably attached to a different one of the rail guides, each electromagnet having at least one pole separated by an airgap from the adjacent reaction bar, the pair of electromagnets oriented so that each exerts a magnetic force opposite in direction from the other of the pair, each actuator also having a means for sensing a flux density in the airgap, and having a magnet driver responsive to magnet commands $C_{1,2}$ from the dual magnet controller for varying the flux density according to the magnet commands; and a means for providing a net force signal $F_{net}$ indicating the magnitude and direction of a net force to be produced by the actuators;

the dual magnet controller comprising:

a net force partitioner responsive to the net force signal $F_{net}$ for providing actuator net force signals $F_{net,1,2}$ for force to be developed by each actuator; and for each actuator, a magnet control loop for providing an actuator command $C_{1,2}$ for driving the actuator, the magnet control loop responsive to a flux density signal $B_{1,2}$ representing flux density in the actuator airgap, and further responsive to the actuator net force signal $F_{net\ 1,2}$;

wherein, depending on which of the two opposite directions the active roller guide controller determines to force the elevator, the dual magnet controller commands one actuator to produce a minimum idling force, and the other actuator to produce an oppositely directed force equal in magnitude to the sum of the minimum idling force and essentially the net force, whereby both actuators produce at least a minimum idling force and the elevator experiences a resultant force equal in magnitude to essentially the net force.

BRIEF DESCRIPTION OF THE DRAWINGS

The above and other objects, features and advantages of the invention will become apparent from a consideration of the subsequent detailed description presented in connection with the accompanying drawings, in which.

BEST MODE FOR CARRYING OUT THE INVENTION

Figure 1:
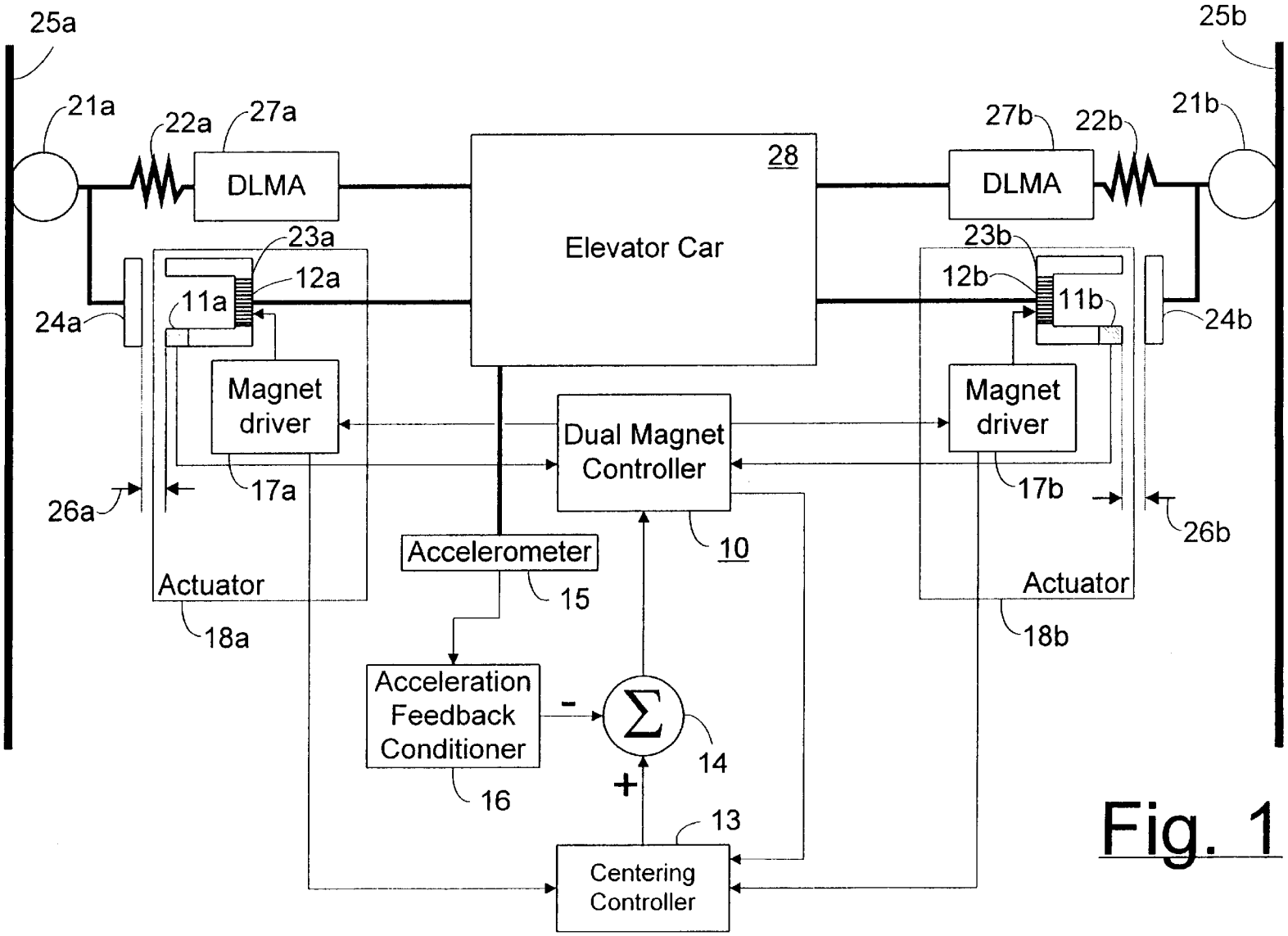
FIG. 1 is a block diagram of an elevator car slidably and flexibly attached to rail guides, and an active roller guide according to the present invention.

Referring now to FIG. 1, an elevator car 28 is slidably and flexibly coupled on opposite sides to guide-rails 25*a–b* through rollers 21*a–b* and springs 22*a–b*. The spring suspensions 22*a-b* are biased using a digital linear magnetic actuator (DLMA) 27*a–b* to initially center the elevator car 28 with respect to the rail guides 25*a–b*.

Also shown in FIG. 1 are various components of an active roller guide with a dual magnet controller according to the present invention. Dual magnet controller 10 is responsive to flux information from a pair of actuators 18*a–b*, one actuator adjacent each rail guide 25*a-b*. In response to input from the actuators and also to a net force signal from a combiner 14, the dual magnet controller determines the force commands to issue to each actuator. The commands require that each actuator 18*a-b* produce a force that in magnitude is at least the minimum idling force, and also require that the actuators in combination produce essentially the net force.

The net force is provided by combiner 14 as the difference in inputs from a centering controller 13 and an acceleration feedback conditioner 16. The centering controller input to combiner 14 is a command for a force that will return the elevator car 28 to a position approximately midway between the rail guides. It determines this command based on the input it receives from each actuator about the current in its electromagnet, and based on input it receives from the dual magnet controller about the force produced by each actuator.

The acceleration feedback conditioner 16 uses input from an accelerometer 15 attached to the elevator car 28 to determine a force that would counter the disturbing forces acting on the elevator car 28. The disturbing forces include wind and forces resulting from deviations in the rail guides 25*a–b*. Combiner 14 inverts the output of the acceleration feedback conditioner before adding it to the output of the centering controller because what is needed is a command for a force that opposes the acceleration of the elevator car due to the disturbing forces.

Each actuator 18*a-b* includes an electromagnet 23*a-b* having a winding 12*a-b* and a flux sensor 11*a-b*. Each actuator also includes a magnet driver 17*a-b* that interfaces with the dual magnet controller. Based on commands from the dual magnet controller, each actuator varies the current in its windings 12*a–b* to produce the force commanded by the dual magnet controller.

Each electromagnet 23*a-b* is adjacent a reaction bar 24*a-b*, which is slidably attached to a rail guide 25*a-b* through a roller 21*a-b*. As the airgap 26*a-b* between the reaction bar 24*a-b* and electromagnet 23*a-b* varies for given winding current, so does the flux density in the airgap. The force drawing the electromagnet to the reaction bar is proportional to the square of the flux density in the airgap.

Figure 2:
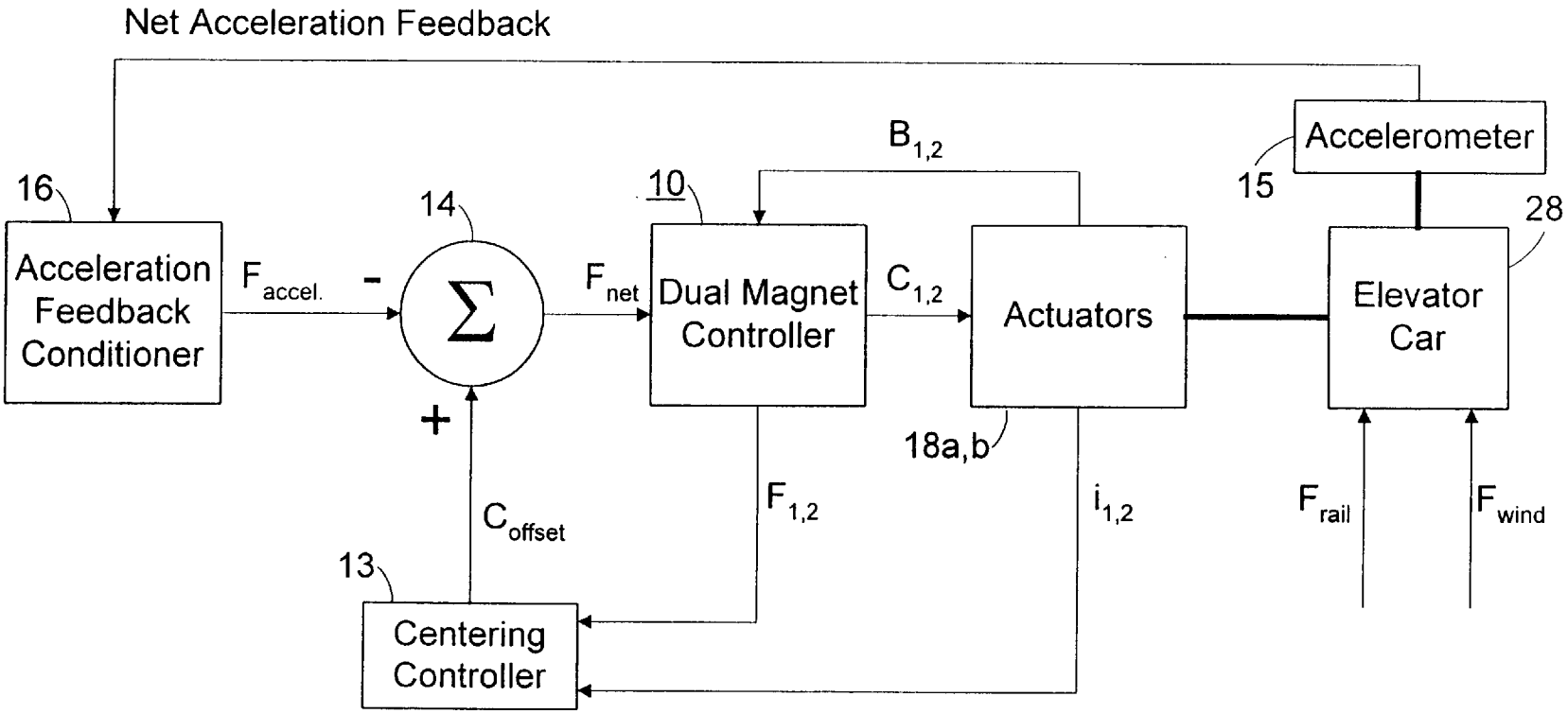
FIG. 2 is a block diagram of the control loops of an active roller guide with a dual magnet controller according to the present invention.

Referring now to FIG. 2, an active roller guide with a dual magnet controller according to the present invention is shown in block diagram indicating more particularly the signal communication between elements. The elevator car 28 is acted on by disturbing forces $F_{wind}$ associated with wind in the hoistway, and $F_{rail}$ associated with deviations in the rail guides 25*a–b* (FIG. 1). An accelerometer 15 attached to the elevator car reports the net acceleration to an acceleration feedback conditioner 16, which smoothes the signals reported over an earlier period of time and periodically produces a signal $F_{accel}$ proportional to the time averaged, smoothed acceleration. At the same time, centering controller 13 receives information about the current $I_{1,2}$ in the electromagnet of each actuator 18*a-b* and the force $F_{1,2}$ each actuator has been commanded by the dual magnet controller 10 to provide. The centering controller 13 uses this information to determine a force that should be applied by the actuators to center the elevator, and then issues a command $C_{offset}$ corresponding to that force.

A combiner 14 adds the signal from the centering controller and the inverted signal from the acceleration feedback conditioner to produce a net force signal $F_{net}$. The dual magnet controller 10 responds to the net force signal $F_{net}$ and to flux density signals $B_{1,2}$, representing the flux densities in each actuator, to provide for each actuator a command $C_{1,2}$ based on having each actuator produce at least a minimum idling force. The command $C_{1,2}$ for each actuator adjusts the current in the actuator to bring the force up to at least the minimum idling force and to provide that the difference in the forces produced by both actuators equals the net force, in a time-averaged, smoothed measure.

Figure 3:
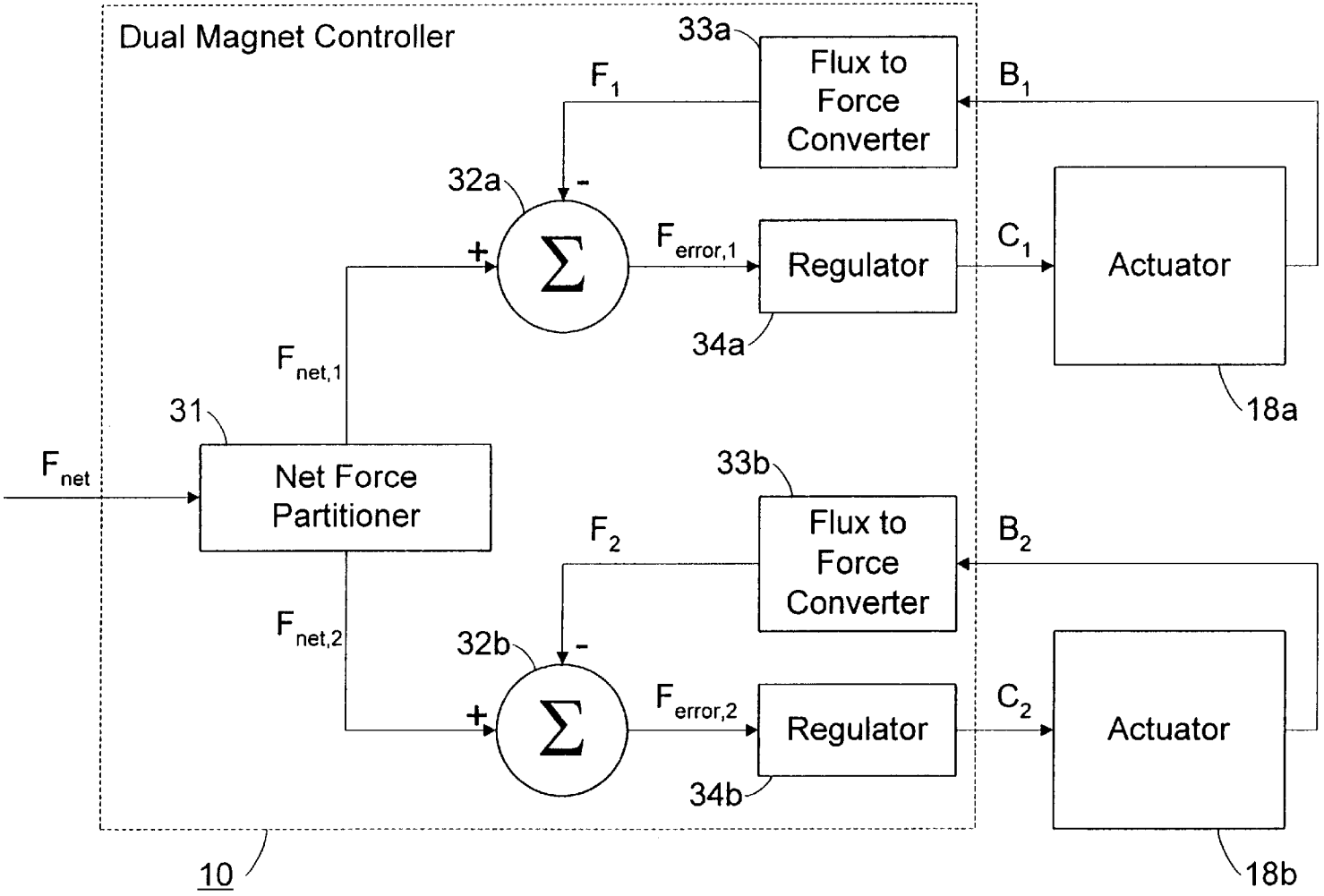
FIG. 3 is an exploded block diagram of the control loops of a dual magnet controller according to the present invention.

Referring now to FIG. 3, a dual magnet controller according to the present invention is shown in exploded block diagram detail. The net force from the combiner 14 (see FIG. 2) is applied to the net force partitioner 31, which, depending on the sign of the net force, determines signals $F_{net,1,2}$ corresponding to the forces each actuator is to produce. These net force signals $F_{net,1,2}$ are input to combiners 32*a–b*. The combiners add the individual net force signals to the inverted signals $F_{1,2}$ representing the forces produced by the actuators. Each combiner output is a signal $F_{error,1,2}$ representing the difference between the force being provided by the actuator and the force the actuator is to provide. Each difference signal is applied to a regulator 34*a-b*, which converts the signal to a command $C_{1,2}$ for an actuator.

The force being produced by an actuator is determined by a flux-to-force converter 33*a-b* in response to receiving a flux density signal $B_{1,2}$ from the actuator 18*a-b* representing the flux density in the airgap of the actuator. To determine the force associated with flux density sensed in the airgap between the pole of an actuator magnet and the adjacent reaction bar, the flux-to-force converter typically uses a simple relation $$F = \frac{B^2}{2\mu_0} A \tag{1}$$

in which $\mu_0$ is the permeability of free space, and A is an effective cross-sectional area of a pole of the actuator magnet.

Figure 4:
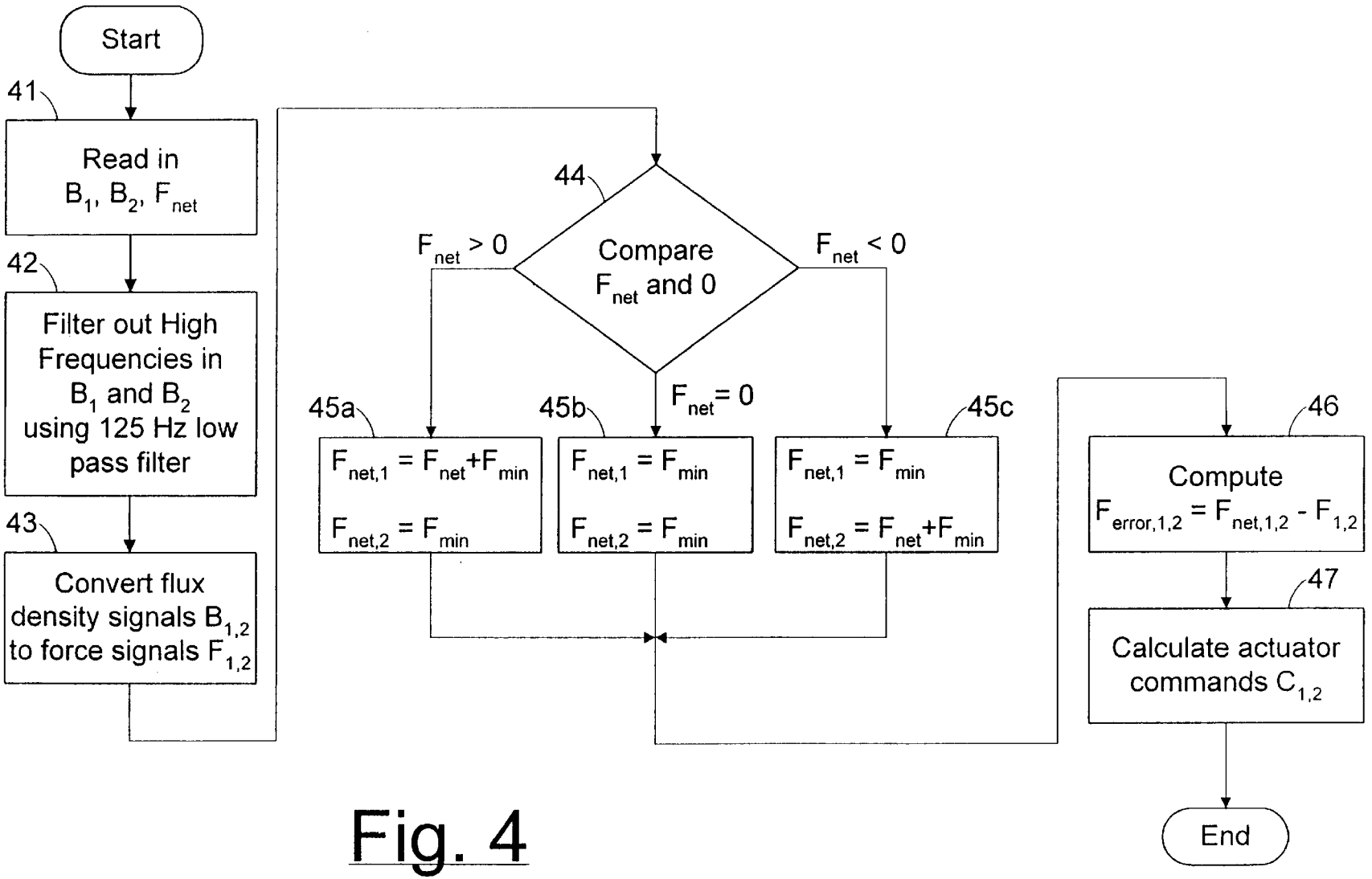
FIG. 4 is a process diagram of a dual magnet controller according to the present invention.

FIG. 4 is a process flow diagram for the process performed 250 times each second by the dual magnet force controller 10 (see FIG. 3). In step 41 the controller responds to signals $B_1$, $B_2$, and $F_{net}$ representing fluxes in each of the electromagnets and the net force the actuators must provide. The controller filters out the high frequencies of the flux densities producing new smoothed values using a 125 Hz low pass filter (Step 42). After converting the flux density signals $B_{1,2}$ to force signals $F_{1,2}$ (Step 43), the controller determines the force signals $F_{net,1,2}$ for each actuator by first determining the polarity of the net force, i.e. the direction the net force should point, from the vantage point of the elevator car (Step 44).

If the net force is positive, and a positive net force corresponds to forcing the elevator in the direction of actuator No. 1, then the force to be provided by actuator No. 1 is set to the net force plus the minimum idling force and the force to be provided by actuator No. 2 is set to simply the minimum force (Step 45*a*). If the net force is negative, and a negative net force corresponds to forcing the elevator in the direction of actuator No. 2, then the force to be provided by actuator No. 2 is set to the net force plus the minimum idling force and the force to be provided by actuator No. 1 is set to simply the minimum force (Step 45*c*). If the net force is zero, then the forces to be provided by actuators No. 1 and 2 are both set to the minimum idling force (Step 45*b*).

Based on determination of the force each actuator is to provide, a signal representing the difference in that force and the force being produced by the actuator is determined (Step 46). Finally, a regulator for each actuator calculates a magnet command $C_{1,2}$ that will result in the actuator producing a force related to the actuator force signals $F_{net,1,2}$ (Step 47).

The magnet commands $C_{1,2}$ typically do not correspond precisely to the net actuator force signals $F_{net,1,2}$. Instead, in order to improve control by the dual magnet controller, the commands $C_{1,2}$ are calculated to include some lag compensation. For example, in a dual magnet controller, the regulator for magnet no. 1 may issue an actuator command calculated according to a formula $$C_1 = g(Y_1 C_{1,old} + Y_2 F_{error,1} + Y_3 F_{error,1,old}) \tag{2}$$

where g is a system gain, and the $Y_{1,2,3}$ are coefficients determined based on the sample rate of the lag filter break frequencies.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A dual magnet controller in an active roller guide for an elevator slidably and flexibly coupled to a pair of rail guides extending along a vertical hoistway, the active roller guide for controlling lateral motion of the elevator, the active roller guide including:

a pair of actuators, each actuator having an electromagnet attached to the elevator adjacent a reaction bar, each reaction bar slidably attached to a different one of the rail guides, each electromagnet having at least one pole separated by an airgap from the adjacent reaction bar, the pair of electromagnets oriented so that each exerts a magnetic force opposite in direction from the other of the pair, each actuator also having a means for sensing a flux density in the airgap, and having a magnet driver responsive to magnet commands $C_{1,2}$ from the dual magnet controller for varying the flux density according to the magnet commands; and a means for providing a net force signal $F_{net}$ indicating the magnitude and direction of a net force to be produced by the actuators;

the dual magnet controller comprising:

a net force partitioner responsive to the net force signal $F_{net}$ for providing actuator net force signals $F_{net,1,2}$ for force to be developed by each actuator; and for each actuator, a magnet control loop for providing an actuator command $C_{1,2}$ for driving the actuator, the magnet control loop responsive to a flux density signal $B_{1,2}$ representing flux density in the actuator airgap, and further responsive to the actuator net force signal $F_{net,1,2}$;

wherein, depending on which of the two opposite directions the active roller guide controller determines to force the elevator, the dual magnet controller commands one actuator to produce a minimum idling force, and the other actuator to produce an oppositely directed force equal in magnitude to the sum of the minimum idling force and essentially the net force, whereby both actuators produce at least a minimum idling force and the elevator experiences a resultant force equal in magnitude to essentially the net force.

2. A dual magnet controller as claimed in claim 1, wherein each magnet control loop comprises:

a flux to force converter, responsive to the flux density signal $B_{1,2}$ representing flux density in the actuator airgap, for providing a signal $F_{1,2}$ representing a force associated with the flux density in the actuator airgap;

a combiner, responsive to the signal $F_{1,2}$ representing a force associated with the flux density in the actuator airgap, and further responsive to one of the actuator net force signals $F_{net,1,2}$, for providing an actuator difference signal $F_{error,1,2}$; and a regulator, responsive to the actuator difference signal $F_{error,1,2}$ for providing the actuator command $C_{1,2}$ for driving the actuator.

3. A dual magnet controller as claimed in claim 2, wherein the flux to force converter for each actuator derives force F acting on the elevator car because of flux density B in the actuator airgap, according to a relation $$F = \frac{B^2 A}{2\mu_0},$$

where $\mu_0$ is the permittivity of free space, and where A is a constant of proportionality related to the cross-sectional area of an actuator electromagnet pole.

* * * * *